United States Patent [19]

Derbyshire et al.

[11] Patent Number: 4,623,401

[45] Date of Patent: Nov. 18, 1986

[54] HEAT TREATMENT WITH AN AUTOREGULATING HEATER

[75] Inventors: Rodney L. Derbyshire, Menlo Park; Paul F. Busch, Los Altos Hills, both of Calif.

[73] Assignee: Metcal, Inc., Menlo Park, Calif.

[21] Appl. No.: 827,680

[22] Filed: Feb. 10, 1986

Related U.S. Application Data

[63] Continuation of Ser. No. 586,719, Mar. 6, 1984, abandoned.

[51] Int. Cl.[4] ..... C21D 9/14

[52] U.S. Cl. ..... 148/13; 148/154

[58] Field of Search ..... 148/4, 145, 150, 154, 148/11.5 R, 16, 13; 219/107.5, 107.9, 10.41, 10.77, 229, 233, 495, 553

[56] References Cited

U.S. PATENT DOCUMENTS

| | | | |
|---|---|---|---|
| 2,785,263 | 3/1957 | Van Iperen | 219/10.41 |
| 3,218,384 | 11/1965 | Shaw | 219/233 |
| 4,001,054 | 1/1977 | Makepeace | 148/145 |
| 4,091,813 | 5/1978 | Shaw et al. | 219/233 |
| 4,185,632 | 1/1980 | Shaw | 219/233 |
| 4,229,235 | 10/1980 | Matsuda et al. | 148/127 |
| 4,256,945 | 3/1981 | Carter et al. | 219/10.79 |

FOREIGN PATENT DOCUMENTS 1076772 7/1967 United Kingdom .

OTHER PUBLICATIONS

"New Method of Preventing Ice Formation on Exposed Power Conductors", Toms et al, Proc., IEE, vol. 112, No. 11, Nov. 1965, p. 2125.

*Primary Examiner*—L. Dewayne Rutledge
*Assistant Examiner*—S. Kastler
*Attorney, Agent, or Firm*—Hall, Myers & Rose

[57] ABSTRACT

Apparatus and process for selectively heat treating at least a portion of an article in the field with autoregulated heating. The autoregulated heating is provided by a heater including at least a first magnetic material disposed along the portion of the article to be heat treated. The first magnetic material has a magnetic permeability which sharply changes at temperatures at or near the autoregulating (AR) temperature thereof. The changes in permeability result in corresponding changes in the skin depth of the first magnetic material and, hence, the heating produced therein responsive to a.c. current passing therethrough. By maintaining the a.c. current constant in amplitude and frequency, the first magnetic material and the portion of the article are regulated at substantially the AR temperature of the first magnetic material. By selecting the first magnetic material to have AR temperature substantially corresponding to the temperature at which metal anneals, tempers, hardens, softens, stress relieves or the like, heat treating at an autoregulated temperature is achieved. The autoregulated heater can be incorporated into the article or can be applied to the article thereafter, in each case permitting in field heat treating. Autoregulated heating can also be achieved by any of various multilayer structures to provide desired autoregulation effects.

14 Claims, 7 Drawing Figures

FIG. I
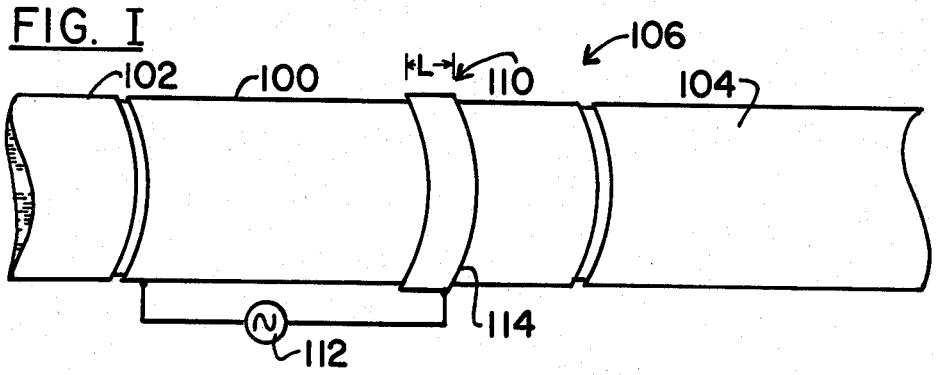
FIG. II
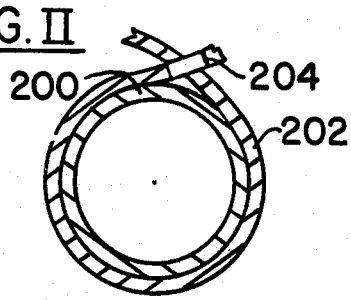
FIG. III
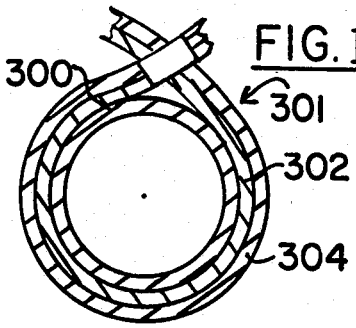
FIG. IV
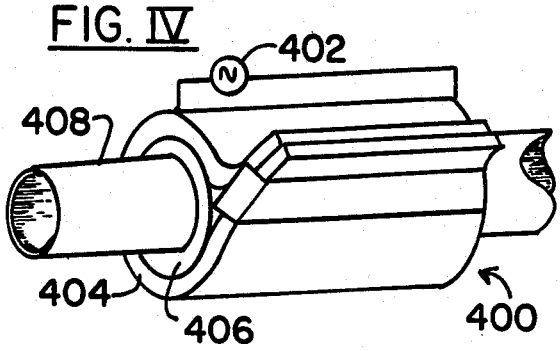
FIG. VII
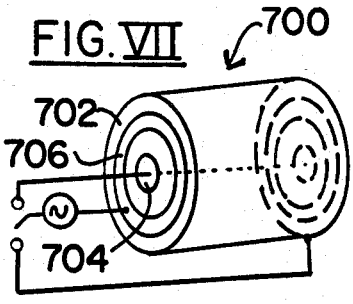
FIG. V
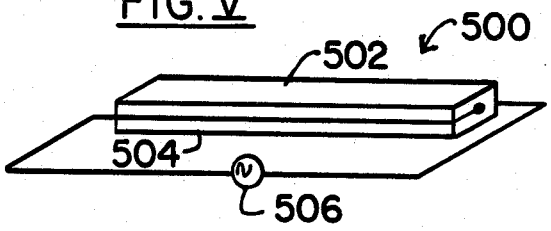
FIG. VI
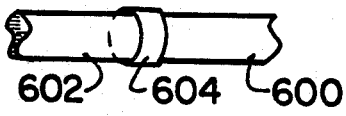

HEAT TREATMENT WITH AN AUTOREGULATING HEATER

This is a continuation of application Ser. No. 586,719 filed Mar. 6, 1984 now abandoned.

BACKGROUND OF THE INVENTION

In the field of metallurgy, heat treatment is employed to achieve numerous results. In a broad sense heat treatment includes any thermal treatment intended to control properties. With respect to metal alloys, such as steel, tempering and annealing are particularly well known methods of heat treatment.

Heat treating to achieve a desired alteration of properties is often times a process that is performed optimally at a specific temperature. In order to maintain control over temperature during such heat treatment, temperature chambers and complex heater/thermostat arrangements are generally employed.

Typically, heat treating is performed before an article is sent to the field—the properties of the article being defined at the mill, factory, or other producing facility. However, at the time of installation of the article or after the article has been in use for a period of time, it may be deemed desirable to effectuate changes in the metallurgical properties of the article in the field, or in situ, without the need for a temperature chamber, oven or heater-thermostat arrangement. For example, where a pipe section along a pipeline is subject to cold temperatures and attendant degradation of properties, it is often desirable to service the pipe section by heat treatment in the field without the need for removing the section. Similarly, when stress, fatigue, or temperature adversely affect a section of pipe along a pipeline or a strut along a bridge or the like, heat treatment in the field is often desirable. In addition, steels exposed to heavy neutron irradiation are generally embrittled. Stress relief in situ is again often of great value.

In these and other situations, it is often found that only portions of an article require heat treatment and that, in fact, the heat treatment should be confined to only those portions and that those portions be heated to a uniform temperature. That is, it may be that only part of an article is to be hardened, softened, strengthened, stress-relieved, tempered, annealed, or otherwise treated—in which case it is desired that heat treating be localized.

SUMMARY OF THE INVENTION

In accordance with the invention, apparatus and process are provided wherein an article of metal can be heat treated to effectuate property changes therein in the field by an autoregulating heater. The autoregulating heater is disposed along the portions of the article to be heat treated, thereby achieving the object of local heat treating.

Moreover, the autoregulating heater includes at least a first magnetic material which changes sharply in skin depth between temperatures below and above an autoregulating temperature (AR). The AR temperature is closely related to and determined by the Curie temperature. The changing skin depth results in corresponding variations in the level of heat produced in response to an a.c. current being applied to the first magnetic material. Accordingly, as discussed in U.S. Pat. No. 4,256,945 to Carter and Krumme, and entitled "AUTOREGULATING HEATER" which is incorporated herein by reference, the heat generated is inversely related to the temperature of the heater. The inverse relationship between the temperature of the heater and the heat generated thereby renders the heater autoregulating or self-regulating. Hence, it is an object of the invention to heat treat a metal article in the field to a temperature determined by an autoregulating heater.

Furthermore, it is an object of the invention to generate autoregulating heat in at least one magnetic layer of an autoregulating heater, wherein the magnetic layer has an AR temperature substantially corresponding to the temperature at which heat treatment—such as tempering or annealing—is to be conducted.

It is yet another object to provide an autoregulating heater along an article to be heat treated, wherein the heater has at least two thermally conductive layers—one comprising a magnetic layer and another comprising a low resistance nonmagnetic layer—wherein the magnetic layer has an AR temperature which substantially corresponds to the desired temperature for heat treatment of the article. According to this embodiment, a.c.current flows primarily through a shallow depth of the magnetic layer below the AR temperature and into the low resistance non-magnetic layer above the AR temperature, thereby greatly reducing heat generation at temperatures above the AR temperature. Autoregulation at a temperature substantially corresponding to the desired heat treatment temperature is achieved at generally several degrees less than the Curie point of the magnetic layer. Moreover, by properly defining the thickness of the low resistance non-magnetic layer a shielding effect is achieved for applications in which the generation of signals outside the heater is not desired.

In a further embodiment, a plurality of magnetic layers are provided in an autoregulating heater that is disposed along and transfers heat to an article in the field that is to be heat treated. In accordance with this embodiment, a.c. current can be selectively applied to the magnetic layers so that regulation at different AR temperatures—corresponding to the different magnetic layers—can be achieved. In this way, an article may be heat treated at any of several temperatures. Where heat treating, such as tempering, may include a plurality of stages—each characterized by given temperature and time specifications—this embodiment enables selected regulation at selectable temperatures. Interposing a low resistance non-magnetic layer between and in contact with two magnetic layers may also be employed in the autoregulating heater to enable selectable temperature regulation in heat treating an article in the field.

It is yet another object of the invention to incorporate any one of the autoregulating heaters set forth above into the article or portion thereof that is to be heat treated. The article-heater may be installed and, as required, the heater may be actuated by connecting a.c. current thereto to effectuate heat treatment in the field. In this regard, the heater may be fixedly imbedded in the article or may, alternatively, be integrally formed along the article. In the case of a steel pipe for example, the pipe itself may comprise a magnetic layer of the autoregulating heater.

It is still yet another object of the invention to provide a process whereby an autoregulating heater may be wrapped about a selected portion of a metal article in the field and the heater autoregulates at a corresponding AR temperature of a magnetic layer thereof—the magnetic layer being selected to have an AR temperature substantially corresponding to the desired heat treating temperature.

It is thus a major object of the invention to provide efficient, practical heat treatment without requiring an oven furnace, or complex heater/thermostat in a controlled atmosphere and heat treatment that is conveniently performed in the field.

Finally, it is an object of the invention to provide autoregulated heating of an article to obtain, retain, and/or regain desired metallurgical properties therein by heat treating to harden, soften, relieve stress, temper, anneal, strengthen, or otherwise render the metallurgical properties of the article more appropriate for its function or end use. For example, the invention contemplates relieving stress in articles or portions thereof which have been over-hardened in the field or which have been rendered brittle due to exposure to radiation or which have been heavily work hardened due to machining or which have undergone fatigue cycling while in the field which might lead to fracture or failure. Also, the invention contemplates heat treating tooled steel in the field and surface treating an article by nitriding or carborizing at a proper heat treating temperature.

BRIEF DESCRIPTION OF THE DRAWINGS

FIG. I is an illustration of pipe being heat treated in situ by an autoregulating heater in accordance with the invention.

FIGS. II and III are cross-section views of two alternative types of autoregulating heaters.

FIG. IV is a front perspective view of an embodiment of the invention that is illustrated in FIG. III.

FIG. V is a view illustrating an embodiment of the invention wherein a spring is heat treated to optimize its end-use properties.

FIG. VI is an illustration of an autoregulating heater and article to be heat treated integrally incorporated into a single crimp element.

FIG. VII is a front perspective view of a three-layer pipe which is both the article to be heat treated and an autoregulating heater which selectively controls the temperature of heat treatment.

DESCRIPTION OF THE INVENTION

Referring to FIG. I, a metal pipe section 100 is shown coupled between two other pipe sections 102 and 104. The pipe section 100 is located along a pipeline 106 which, preferably, carries a fluid—such as oil or gas. When so employed, the pipe section 100 is often times exposed to numerous conditions that may adversely affect the structure and properties thereof. For example, thermal changes may result in stressing the pipe section 100. In addition, welds along the pipe section 100 may require stress relief after field welding. To relieve such stress or otherwise enhance the metallurgical properties of the pipe section 100, an autoregulating heater 110 for heat treating the pipe section 100 in the field (in situ) is provided. In this regard, it must be realized that accurate heat treating control is important to avoid overheating or underheating which seriously detracts from the heat treatment. As discussed below, the autoregulating heater 110 may be of various forms—in each case the autoregulating heater 110 (a) being disposed along the pipe section 100 (or other workpiece) in the field along a length that is to be heat treated and (b) regulating at a temperature appropriate to heat treat the section 100 in the field. Moreover, the autoregulating heater 100 is of a nature which permits the maintaining of a uniform temperature locally along the length L of the pipe section 100 to be heat treated.

Referring still to FIG. I, an a.c. current source 112 is shown. The source 112 provides a "constant" current which, preferably, is at a selected fixed frequency. The current is applied to enable the current to flow through a heating structure 114.

Several embodiments of heating structure 114 are illustrated in FIGS. II and III. In FIG. II, the pipe section 200 is shown encompassed by a single magnetic layer 202. The magnetic layer 202 has a clamp member 204 which enables the magnetic layer 202 to be wrapped and held around the pipe section 200 in the field. The magnetic layer 202 has a prescribed resistivity ($\rho$) and a permeability ($\mu$) which varies sharply—at points above and below an autoregulation (AR) temperature. The AR temperature is typically a few degrees lower than the conventionally defined—Curie temperature of the magnetic layer 200. A sample table of magnetic materials is set forth below.

TABLE

| MATERIAL | CURIE POINT | $\rho$ ($\Omega$-cm) | EFFECTIVE PERMEABILITY |
|---|---|---|---|
| 30% Ni Bal Fe | 100° C. | $80 \times 10^{-6}$ | 100-300 |
| 36% Ni Bal Fe | 279° C. | $82 \times 10^{-6}$ | ↓ |
| 42% Ni Bal Fe | 325° C. | $71 \times 10^{-6}$ | 200-600 |
| 46% Ni Bal Fe | 460° C. | $46 \times 10^{-6}$ | ↓ |
| 52% Ni Bal Fe | 565° C. | $43 \times 10^{-6}$ | ↓ |
| 80% Ni Bal Fe | 460° C. | $58 \times 10^{-6}$ | 400-1000 |
| Kovar | 435° C. | $49 \times 10^{-6}$ | ↓ |

As is well known, the permeability ($\upsilon$) of the magnetic layer 202 corresponds substantially to the effective permeability well below the AR temperature and approximately one above the AR temperature. This variation in permeability with temperature results in a corresponding change in skin depth, where skin depth is proportional to $$\sqrt{\frac{\rho}{\mu f}}.$$

That is, as temperature increases to above the AR temperature, the permeability falls to one from, for example, 400 which results in the skin depth increasing by a factor of 20. The increase in skin depth, in turn, results in an increase in the cross-section through which a.c. current is primarily confined. In this regard, it is noted that a.c. current distribution relative to depth in a magnetic material is an exponential function, namely current falls off at the rate of $1\text{-}e^{t/}$S.D. where t is thickness and S.D. is skin depth. Accordingly, 63.2% of the current is confined to one skin depth. That is, where $I^2R$ is the heat generated and where $I^2$ is considered relatively "constant38 , changes in R primarily determine changes in heat generation. Hence, as the temperature of the magnetic layer 202 increases above the AR temperature, the $I^2R$ heat generated drops. Conversely, as the temperature drops below the AR temperature, the $I^2R$ heat increases in accordance with skin depth changes. This effect is what characterizes a heater as autoregulating or self-regulating.

It should be noted that according to the invention a current is considered "constant" if the change in current ($\Delta I$) and change in resistance ($\Delta R$) follow the relationship:

$$\frac{\Delta I}{I} > -\frac{1}{2}\frac{\Delta R}{R}.$$

Still referring to FIG. II, it is noted then that as "constant" a.c. current is applied to the magnetic layer 202 the current is confined to a shallow depth about the outer periphery thereof when the temperature of the magnetic layer 202 is below the AR temperature thereof. As the temperature increases and exceeds the AR temperature, the skin depth spreads to deeper thicknesses and current thereby flows through a larger cross-section. The heat generated is thereby reduced.

In that the magnetic layer 202 is thermally conductive, the heat generated thereby when the skin depth is shallow is transferred to the pipe section 200. Moreover, since each portion of the magnetic layer 202 generates heat in response to its temperature, the heat is distributed so that greater heat is supplied to colder areas and less heat is supplied to warmer areas. Thus, heat from the magnetic layer 202 serves to raise the temperature of the length L (see FIG. I) to a uniform level. In accordance with the invention as embodied in FIG. II, the uniform level substantially corresponds to the AR temperature of the magnetic layer 202 and the temperature at which the desired heat treatment of the length L is effectuated.

Specifically, the AR temperature of the first magnetic layer 202 is selectable to correspond to the tempering temperature or the annealing temperature of the pipe section 100. In this regard it is noted that autoregulation temperatures—near the Curie points—as high as 1120° C. (the Curie temperature of Cobalt) are readily achievable by proper selection of magnetic alloy for the magnetic layer 202.

The heat treatment of steel and other metals (e.g. alloys) from which the pipe section 100 can be made is typically performed at temperatures below the autoregulation upper limits. Accordingly, the proper selection of an alloy wherein AR temperature substantially corresponds to the desired heat treatment temperature can be made.

Where heat treating is normally conducted for a given period of time, it is further noted that the source 112 may be selectively switched on and off to provide the desired heat treatment period. Alternatively, the heater (or heater/article) may have plug or contact elements to which the source 112 can be selectively connected or disconnected as desired.

Referring again to FIG. I, it is observed that the source 112 is connected to the pipe section 100 and the magnetic layer 110. In this embodiment the pipe section 100 may be a low resistance non-magnetic material. As the skin depth of the magnetic layer 110 increases, current will eventually spread to the pipe section 100. The resistance R thereby drops sharply and little $I^2R$ heat is produced. If needed, a circuit (not shown) may be provided to protect the source 112. The magnetic layer 110, it is noted, has a thickness defined to enable current to spread into pipe section 100 when temperatures rise above the Curie temperature. Preferably the magnetic layer is 1.0 to 1.8 skin depths (at the effective permeability) in thickness although other thicknesses may be employed.

Still referring to FIG. I, if the pipe section 100 is not of a low resistance material, the source 112 would be connected directly across the magnetic layer 110 which, as desired, may include coupling elements (not shown) for receiving leads from the source 112.

Turning now to FIG. III, pipe section 300 is encircled by a heater 301 that includes a low resistance layer 302 (e.g. copper) which is encircled by magnetic layer 304. The layers 302 and 304 are in contact with each other and are each thermally conductive. An a.c. current is applied to the heater 301, the current being primarily confined to a shallow depth below the AR temperature and the current spreading to flow along the low resistance path above the AR temperature. The pipe section 300 has heat supplied thereto by the autoregulating heater 301 to portions of the pipe section 300 in contact therewith.

FIG. IV shows the connection of substantially constant a.c. current to an autoregulating heater 400 which is similar to heater 301. A source 402 supplies a.c. current which is initially confined to the outer skin of an outer magnetic layer 404. The inner layer 406 comprises a low resistance, non-magnetic layer 406 which encompasses a solid article 408—such as a pipe, strut, girder, or the like. When the magnetic layer 404 is below its AR temperature—which is typically several degrees below the Curie point—considerable heat is generated therein. As the temperature climbs to the AR temperature, a.c. current penetrates into the low resistance layer 406 resulting in a decrease in generated heat. That is, as is known in the art, the a.c. current flows mainly along the outer surface of layer 404—the surface adjacent the circuit loop—when the temperature is below the AR temperature. When the temperature reaches the AR temperature, the a.c. current spreads through the layer 404, which preferably has a thickness of several skin depths when the layer 406 is at its effective permeability, and into the layer 406 resulting in less $I^2R$ heat.

A connection of a.c. to the embodiment of FIG. II may be made in a manner similar to that shown in FIG. IV. Moreover, the heater of FIG. II may also encircle a solid article—rather than the hollow article shown therein—to achieve the heat treatment thereof. Such heat treatment includes tempering, annealing, strengthening, increasing ductility, relieving stress, or otherwise affecting the metallurgical properties of a metal member. The heat treatment may be effected during assembly, repair, or servicing of the metal member to obtain, retain, or regain desired properties.

Referring now to FIG. V, a spring 500 comprises a Beryllium-copper layer 502 and a magnetic alloy layer 504. The Beryllium-copper layer 502 in a soft and ductile condition may be formed and fit to be placed in a desired location. After placement, the magnetic alloy layer 504 has a.c. current supplied thereto by a source 506—which results in the heater 500 initially increasing in temperature. The temperature is regulated at the Curie temperature of the layer 504. The regulated temperature substantially corresponds to the temperature at which the Beryllium-copper layer 502 hardens to a strong, spring-temper condition. This heat treating is preferably conducted for several minutes at about 400° C. Other alloys, such as aluminum and magnesium alloys may also be hardened by such short, low temperature treating. Due to their high inherent conductivity, fabricating such alloys into the heater is contemplated by the invention.

In addition to hardening, it is noted that alloys may soften if heated too hot or too long. Accordingly, the invention contemplates softening as well in situ.

Referring next to FIG. VI, a power cable 600 is terminated at a terminal bus 602 by a clamp ring 604. The ring 604 is initially soft to crimp and conform well to form the termination. The ring 604 comprises a magnetic alloy (see table above) which has an a.c. current applied thereto. The ring 604 autoregulates at the AR temperature thereof and hardens to achieve the desired end-use functionality. The crimp 604 represents both the article to be heat treated and the heater.

In reviewing FIGS. I through IV, it should be noted that the invention described therein is not limited to embodiments in which a heater is wrapped around an article in the field. The invention also extends to embodiments wherein the heater and article are incorporated as a single structure. That is, the article to be heated may itself comprise a magnetic material which autoregulates its own temperature. Moreover, the article may include plural layer embodiments where, for example, a pipe as in FIG. I, may include a magnetic layer and a non-magnetic layer concentric and disposed against the magnetic layer. Such an embodiment operates like the layers 302 and 304 of FIG. III. Similarly, the pipe may comprise two magnetic layers with a non-magnetic layer interposed therebetween. This embodiment operates like the three layers 404 through 408 of FIG. IV, except that the heater 402 is not only disposed along but is also at least part of the article being heat treated. FIG. VII shows a three layer pipe 700 including two concentric magnetic layers 702, 704 with a non-magnetic layer 706 therebetween. A "constant" a.c. source 708 is switchably connectable so that current flows along either the outer surface or inner surface of the pipe 700 when below the AR temperature of layer 702 or of layer 704 respectively. The pipe 700 comprises both the article to be heat treated and the heater disposed therealong.

In any of the embodiments, it is further noted, heat treatment may be performed repeatedly as required by simply connecting the a.c. source and applying current to the heater.

Moreover, in yet another embodiment of heat treating in the field, the invention contemplates heating a metal by any of the various mechanisms discussed above and flushing the heated metal in the field with a gas to effectuate nitriding or carborizing. Carborizing and nitriding are known forms of surface-treating which, in accordance with the invention, are performed in the field, when the article is at the autoregulated temperature.

Given the above teachings, it is noted that insulation and circuit protection may be included in the various embodiments by one of skill in the art.

Other improvements, modifications and embodiments will become apparent to one of ordinary skill in the art upon review of this disclosure. Such improvements, modifications and embodiments are considered to be within the scope of this invention as defined by the following claims.

I claim:

1. A process for altering the metallurgical properties of a metal article, the process comprising the steps of:

uniting the article with an autoregulating heater which is operable in the field, to provide autoregulated heat to at least a portion of the article;

forming the autoregulating heater to include a first magnetic material having an autoregulating (AR) temperature substantially corresponding to at least a heat treating temperature of the article;

selecting the first magnetic material having an effective magnetic permeability which is at least 100 at temperatures below the AR-temperature;

selecting a second magnetic material having an AR temperature higher than the AR temperature of the first magnetic material;

defining the first magnetic material as a first layer;

defining the second magnetic material as a second layer;

positioning the first layer and the second layer against each other in electrical contact;

whereby current flows mainly through a shallow depth of the first layer when the magnetic permeability thereof greatly exceeds 1;

wherein substantial current flows in the second layer when the magnetic permeability of the first layer is substantially one; and driving the temperature of the heater and the article united therewith to at least approximately the Curie temperature of the first magnetic material, which includes the step of:

applying an a.c. current of substantially constant amplitude and frequency to the first magnetic material.

2. a process as in claim 1 wherein said heat treating includes the step of annealing at least a portion of the article.

3. A process as in claim 1, wherein said heat treating includes the step of tempering at least a portion of the article.

4. A process as in claim 1 comprising the further step of:

forming the first magnetic material as an element separate from the article; and positioning the first magnetic material in heat transfer relationship with the portion of the article to be heated.

5. A process as in claim 1, wherein the defining of the second layer includes the step of selecting the second layer to be of low electrical resistance.

6. A process as in claim 1 wherein the driving step is performed in the field.

7. A process as in claim 6, wherein the article and the heater are separate elements; and wherein the uniting step is performed in the field and includes the step of positioning the heater in heat transfer relationship with the portion of the article to be heated.

8. A process as in claim 7, wherein the driving step includes the step of maintaining the temperature of the article to achieve annealing.

9. A process as in claim 7, wherein the driving step includes the step of maintaining the temperature of the article to achieve tempering.

10. A process as in claim 1, comprising the further step of selectively regulating the temperature of the heater and the article to the AR temperature of the first magnetic material or the AR temperature of the second magnetic material.

11. A process as in claim 1, wherein the article is initially in a ductile state; and wherein the process includes the further step of:

shaping the metal to a desired configuration prior to said temperature driving step, said temperature driving step serving to strengthen the article.

12. A process as in claim 1 comprising the further step of:

surface treating the article in situ after the temperature driving step.

13. A process as in claim 12 wherein the surface treating step comprises the step of:

nitriding the article surface.

14. A process for altering the metallurgical properties of a metal article, the process comprising the steps of:

placing the article in thermal contact with a heater which is operable to provide autoregulated heat to at least the contacted region of the article;

forming the autoregulating heater to include a first magnetic material having an effective Curie temperature lying in a range of temperatures falling within at least a range of heat treating temperatures of the article;

selecting the first magnetic material to have an effective magnetic permeability which greatly exceeds 1 at temperatures below the effective Curie temperature;

providing a second magnetic material having an effective Curie temperature higher than the effective Curie temperature of the first magnetic material;

positioning the first magnetic material and the second magnetic material to have extensive surfaces thereof against each other in electrical and thermal contact;

whereby electrical current is confined mainly through a shallow depth of the first magnetic material when the magnetic permeability thereof greatly exceeds 1;

wherein substantial current flows in the second magnetic material when the magnetic permeability of the first magnetic material is substantially below 100; and applying an a.c. current of constant amplitude to the first magnetic material to heat the heater and article to the effective Curie temperature of the first magnetic material.

* * * * *